US009975618B2

(12) United States Patent
De Turckheim

(10) Patent No.: US 9,975,618 B2
(45) Date of Patent: May 22, 2018

(54) FRAME DEVICE FOR A PROFILED SAIL DEVICE AND PROFILED SAIL DEVICE

(71) Applicant: SoftWing SA, Lausanne (CH)

(72) Inventor: Hugues De Turckheim, La Seyne-sur-Mer (FR)

(73) Assignee: SoftWing SA, Lausanne (CH)

( * ) Notice: Subject to any disclaimer, the term of this patent is extended or adjusted under 35 U.S.C. 154(b) by 0 days. days.

(21) Appl. No.: 15/128,353

(22) PCT Filed: Mar. 17, 2015

(86) PCT No.: PCT/EP2015/055492
§ 371 (c)(1),
(2) Date: Sep. 22, 2016

(87) PCT Pub. No.: WO2015/144486
PCT Pub. Date: Oct. 1, 2015

(65) Prior Publication Data

US 2017/0106956 A1 Apr. 20, 2017

(30) Foreign Application Priority Data

Mar. 24, 2014 (DE) ..... 10 2014 103 999

(51) Int. Cl.
*B63H 9/04* (2006.01)
*B63H 9/06* (2006.01)
*B63H 9/08* (2006.01)

(52) U.S. Cl.
CPC ..... *B63H 9/0607* (2013.01); *B63H 9/0657* (2013.01); *B63H 9/08* (2013.01); *B63H 2009/0635* (2013.01); *B63H 2009/088* (2013.01)

(58) Field of Classification Search
CPC ..... B63H 9/0607; B63H 9/0657; B63H 9/08
See application file for complete search history.

(56) References Cited

U.S. PATENT DOCUMENTS 1,341,758 A * 6/1920 Parker ..... B64C 3/48 244/219
1,344,244 A 6/1920 Thompson
(Continued)

FOREIGN PATENT DOCUMENTS

DE 8501047 U1 5/1985
DE 9316294 U1 1/1994
(Continued)

OTHER PUBLICATIONS

International Search Report of PCT/EP2015/055492, dated May 18, 2015, 2 pages.

*Primary Examiner* — Stephen P Avila
(74) *Attorney, Agent, or Firm* — Davidson, Davidson & Kappel, LLC

(57) ABSTRACT

A frame device (200) for a profiled sail device, the frame device (200) having at least one adjustable frame element (202), the at least one adjustable frame element (202) having longitudinal struts which are spaced apart from one another and are assigned to sail surfaces which are spaced apart from one another, and transverse struts which extend between the longitudinal struts, characterized in that the longitudinal struts and the transverse struts delimit quadrangles which each have two diagonals with varying lengths depending on the adjustment, and the diagonals each have a predetermined maximum length, and a profiled sail device having sail surfaces which are spaced apart from one another and against which the flow can impinge and which form profiled surfaces, a sail front edge and an adjustable skeleton device arranged between the sail surfaces. The skeleton device has at least one frame device (200) of this type.

19 Claims, 7 Drawing Sheets

(56) References Cited

U.S. PATENT DOCUMENTS

| | | | | |
|---|---|---|---|---|
| 3,658,025 | A | 4/1972 | Hood et al. | |
| 4,386,574 | A | 6/1983 | Riolland | |
| 4,624,203 | A | 11/1986 | Ferguson | |
| 4,757,779 | A | 7/1988 | Graveline | |
| 5,603,276 | A | 2/1997 | Julien | |
| 6,070,834 | A | 6/2000 | Janker et al. | |
| 7,574,972 | B1 * | 8/2009 | Fairchild ..... | B63H 9/0607 114/102.22 |
| 9,199,709 | B2 | 12/2015 | De Turckheim | |

FOREIGN PATENT DOCUMENTS

| | | | |
|---|---|---|---|
| DE | 69215952 | T2 | 9/1997 |
| DE | 19653851 | | 6/1998 |
| EP | 511050 | A1 | 10/1992 |
| EP | 0511050 | A1 | 10/1992 |
| FR | 2036208 | A5 | 12/1970 |
| FR | 2445267 | A1 | 7/1980 |
| FR | 2676032 | | 11/1992 |
| GB | 2119730 | A | 11/1983 |
| WO | WO2012168048 | A1 | 12/2012 |

* cited by examiner

FRAME DEVICE FOR A PROFILED SAIL DEVICE AND PROFILED SAIL DEVICE

The present invention relates to a frame device for a profiled sail device, the frame device including at least one adjustable frame element, the at least one adjustable frame element including longitudinal beams spaced apart from one another, which are assigned to sail areas spaced apart from one another and transverse beams, which extend between the longitudinal beams. The present invention furthermore relates to a profiled sail device including incident-flow sail areas spaced apart from one another which form profile surfaces, a sail leading edge, and an adjustable skeleton device situated between the sail areas.

BACKGROUND

A frame device for a profiled sail device is known from WO 2012/168048 A1, the frame device including multiple frame elements which are adjustable in relation to each other, at least one frame element having a first profile contour which is assigned to one sail area and a second profile contour which is assigned to another sail area, the frame device having a profile contour which includes at least one profile contour section formed with the aid of a profile contour of the at least one frame element, and the frame device being adjustable between a first operating position and a second operating position, in which in the first operating position the first profile contour of the at least one frame element forms at least one profile contour section of the frame device for the first sail area or for the second sail area, and the second profile contour of the at least one frame element does not form a profile contour section of the frame device for the sail area, and in the second operating position the first profile contour of the at least one frame element does not form a profile contour section of the frame device for the sail area and the second profile contour of the at least one frame element forms at least one profile contour section of the frame device for the respective other sail area.

From EP 511 050 A1 a device is known, made up of at least one aerodynamically shaped element, of which at least a portion or a zone is foldable, for propulsion and/or for lift under the action of the wind directed thereon, including two surfaces, one each for the pressure (windward) side and for the suction (leeward) side, in which at least one slot is provided to conduct the air flow tangentially to the aforementioned element, the aforementioned slot and the aforementioned control elements of the aforementioned air flow impacting the position and the geometry of at least a portion and/or a zone of the aforementioned element with respect to the geometry and the opening/closure with the aid of devices, and the aforementioned device moreover including means which regulate the geometry of the aforementioned element, at least the shape and depth of the curvature.

From U.S. Pat. No. 4,624,203 A a batten structure for a flow profile is known for use in combination with similar batten structures, the batten structures being held in a spaced relation inside a wing sail, the batten structure including: a beam including a front section having holders for the slidable engagement with a carrier, such as a mast, and a rear section fixedly connected to the front section, a nose part which is pivotably connected to the front end of the beam with the aid of pivot means, in front of the holders, the nose part including side areas which are configured to provide a front end section of a hydrofoil, two flexible elongated batten parts, which each extend rearwardly from opposite sides of the nose part outside the beam, the batten parts being rigidly connected at front ends to the nose part and providing extensions of the side areas and being slidably connected to each other at rear ends rearwardly of the rear end of the beam, and an elongated spreader means having mutually opposing ends, connected to the batten parts, to connect the parts to each other and provide a mobility relative to the beam, the arrangement of the spreader means, beam, nose part and batten parts being such that a sail pressure acting on a windwardly directed batten part is able to flex a central part of this batten part against the beam between the nose part and the rear end of the beam in order to pivot the nose part against the windwardly directed side, while the other batten part is held away from the beam and is held in a convex shape by the spreader means and by the pivoting of the nose part, these shapes of the batten parts, together with the nose part, forming a section of the wing sail which is divided into chambers.

SUMMARY OF THE INVENTION

It is an object of the present invention to structurally and/or functionally improve a frame device mentioned at the outset. Furthermore, a profiled sail device mentioned at the outset is to be improved structurally and/or functionally. In particular, a propulsion is to be enabled with greater efficiency. In particular, a two-way functionality is to be enabled. In particular, a curvature is to be settable independently of the wind pressure. In particular, an operability is to be simplified. In particular, a maximum curvature is to be limitable or limited. In particular, a maximum curvature is to be adaptably limitable or limited multiple times across a cross section of a profiled sail device. In particular, a load-carrying capacity of a limitation is to be increased. In particular, a limitation-induced load should be absorbable in a distributed manner. In particular, a limitation is to be absorbable across a cross section of a profiled sail device in a distributed manner. In particular, a weight is to be reduced. In particular, a load-carrying capacity is to be increased. In particular, an operability is to be simplified.

The present invention provides a frame device for a profiled sail device, the frame device including at least one adjustable frame element, the at least one adjustable frame element including longitudinal beams spaced apart from one another, which are assigned to sail areas spaced apart from one another, and transverse beams, which extend between the longitudinal beams, in which the longitudinal beams and the transverse beams delimit quadrangles, which each have two diagonals having lengths that vary as a function of the adjustment, and the diagonals each having a predetermined maximum length.

The at least one adjustable frame element may be elastically adjustable. Proceeding from a neutral center position, the at least one adjustable frame element may be adjustable between a first end position and a second end position. Proceeding from the neutral center position, the at least one adjustable frame element may be adjustable in the direction of the first end position under the application of a force, and may be adjustable in the direction of the neutral center position when the application of a force is removed or reduced. Proceeding from the neutral center position, the at least one adjustable frame element may be adjustable in the direction of the second end position under the application of a force, and may be adjustable in the direction of the neutral center position when the application of a force is removed or reduced.

The at least one adjustable frame element may have a longitudinal axis. In the neutral center position, the at least one adjustable frame element may have a shape which is symmetrical to the longitudinal axis. When the at least one adjustable frame element is adjusted in the direction of the first end position, the longitudinal axis may be bent in a first direction. When the at least one adjustable frame element is adjusted in the direction of the second end position, the longitudinal axis may be bent in a second direction opposite the first direction.

The longitudinal beams may each have a front end and a rear end. The longitudinal beams may be connected to each other at their front ends. The at least one adjustable frame element may include a bowed section. The longitudinal beams may be connected to each other at their front ends with the aid of the bowed section. The longitudinal beams and the bowed section may be designed in one part. The longitudinal beams and the bowed section may delimit a cross section of the profiled sail device. Proceeding from their front ends, the longitudinal beams may be situated to converge in the direction of their rear ends. The bowed section may be assigned to a front edge of the profiled sail device. The rear ends of the longitudinal beams may be assigned to a rear edge of the profiled sail device.

The rear ends of the longitudinal beams may be free. The rear ends of the longitudinal beams may in particular be displaceable in relation to each other in the extension direction of the longitudinal axis. The longitudinal beams may be elastically bendable. The transverse beams may be used as compression members. The transverse beams may be essentially rigid.

The quadrangles delimited by the longitudinal beams and the transverse beams may each have four corners. The quadrangles may be convex. The quadrangles may be deformable during an adjustment of the at least one adjustable frame element. The quadrangles may be deformable in a parallelogram-like manner during an adjustment of the at least one adjustable frame element. The lengths of the diagonals may change during a deformation of the quadrangles. The quadrangles may each have a first diagonal and a second diagonal. When the at least one adjustable frame element is adjusted to its first end position, the first diagonals may have a maximum length and the second diagonals may have a minimum length. When the at least one adjustable frame element is adjusted to its second end position, the second diagonals may have a maximum length and the first diagonals may have a minimum length. The first diagonals may have a predetermined maximum length. The second diagonals may have a predetermined maximum length. Due to the predetermined maximum length of the diagonals, an adjustability of the at least one adjustable frame element may be limited.

The frame device may include tension elements for predetermining the maximum lengths of the diagonals. The frame device may include first tension elements for limiting the maximum length of the first diagonal to a predetermined value. The frame device may include second tension elements for limiting the maximum length of the second diagonal to a predetermined value. The tension element may each have two ends. The tension elements may each be connected at their ends to the corners of the quadrangles with tensile strength. Tensile stresses may be absorbable with the aid of the tension elements. A further adjustment may be prevented in that the first tension elements or the second tension elements are tensioned.

The tension elements may be limp at least in sections. The tension elements may each have a fixed length. The tension elements may each have a settable length. The fixed or settable length of the tension elements may be used to predetermine the maximum length of the diagonals. The tension elements may be formed with the aid of ropes having a fixed or settable length. The tension elements may each include a rope section having a fixed length and a length-adjustable tension section. The tension sections may each be mechanically, electromechanically, pneumatically and/or hydraulically length-adjustable.

The frame device may include at least one fixed frame element. The at least one fixed frame element may be situated displaceably on the at least one adjustable frame element. The at least one fixed frame element may be situated pivotably on the at least one adjustable frame element. The at least one fixed frame element may be situated slidably on the at least one adjustable frame element. A displacement of the at least one fixed frame element may cause an adjustment of the at least one adjustable frame element. The at least one fixed frame element may be displaceable with the aid of actuatable tension elements.

The frame device may include at least two fixed frame elements. The at least two fixed frame elements may be situated displaceably on the at least one adjustable frame element. The at least two fixed frame elements may be counter-displaceable with the aid of actuatable tension elements.

The frame device may include a first fixed frame element. The first fixed frame element may be situated at the front ends of the longitudinal beams. The first fixed frame element may be pivotably connected to the longitudinal beams. The first fixed frame element may include two coupling points for the connection to the longitudinal beams. Pivot bearings may be used for the pivotable connection. Proceeding from the front ends of the longitudinal beams of the at least one adjustable frame element, the first fixed frame element may extend essentially in the direction of the rear ends of the longitudinal beams. The first fixed frame element, in turn, may include longitudinal beams spaced apart from one another, which are assigned to sail areas spaced apart from one another, and transverse beams, which extend between the longitudinal beams. The longitudinal beams and the transverse beams of the first fixed frame element may delimit quadrangles or a triangle, which each have two diagonals having fixed lengths. Fixed tension elements and/or pressure elements may be situated in the quadrangles.

The frame device may include a second fixed frame element. The second fixed frame element may be situated at the rear ends of the longitudinal beams. The second fixed frame element may be slidably connected to the longitudinal beams. The longitudinal beams of the second fixed frame element and the longitudinal beams of the at least one adjustable frame element may be connected to each other with the aid of sliding sleeves. Proceeding from rear ends of the longitudinal beams of the at least one adjustable frame element, the second fixed frame element may extend essentially in the direction of the front ends of the longitudinal beams. The second fixed frame element, in turn, may include longitudinal beams spaced apart from one another, which are assigned to sail areas spaced apart from one another, and transverse beams, which extend between the longitudinal beams. The longitudinal beams and the transverse beams of the first fixed frame element may delimit a quadrangle or a triangle.

The at least two fixed frame elements may be collectively displaceable in a first displacement direction with the aid of a first tension element, and may be collectively displaceable in a second displacement direction opposite the first displacement direction with the aid of a second tension element. The first tension element and the second tension element may be guided on the at least one adjustable frame element and on the first fixed frame element and connected to the second fixed frame element with tensile strength. Ropes may be used as tension elements.

In the first end position of the at least one adjustable frame element, the at least one fixed frame element may form a profile contour of the frame device for a first sail area of the profiled sail device, while the at least one adjustable frame element may form a profile contour of the frame device for a second sail area of the profiled sail device situated opposite the first sail area. In the second end position of the at least one adjustable frame element, the at least one fixed frame element may form a profile contour of the frame device for the second sail area of the profiled sail device, while the at least one adjustable frame element may form a profile contour of the frame device for the first sail area of the profiled sail device. When the end positions of the at least one adjustable frame element are changed, contact surfaces of the frame elements for the sail areas may change.

The frame elements may be produced in several parts and assembled. The frame elements may be assembled from individual rods, tubes, segments and/or connecting parts. The tubes or rods may have a round cross section. The tubes or rods may have a quadrangular cross section. The frame elements may be produced using a sandwich method. The frame elements may include rollers for deflecting actuating ropes. The frame elements may include passages for actuating ropes. The frame elements may be produced at least partially in one part. The frame elements may be foam-sandwich components. The frame element may include a material such as wood, light metal alloy, plastic material and/or fiber composite. The light metal alloy may be an aluminum alloy or a titanium alloy. The plastic material may be filled. Talc, chalk, kaolin, carbon black, glass spheres and/or glass fibers may be used as fillers. The fiber composite may have a matrix. Duromers, also referred to as synthetic resins, elastomers and/or thermoplastics may be used as the matrix. The fiber composite may include fibers. The fibers used may be glass fibers, carbon fibers, ceramic fibers, aramid fibers, boron fibers, basalt fibers, steel fibers, natural fibers and/or nylon fibers.

The frame device may include an opening for accommodating a mast. The frame device may thus be fixed on the mast. The frame device may be fixed on the mast so as to have limited mobility, in particular mobility in a direction orthogonal to a mast axis. The frame device may be pivotable about the mast. The profiled sail device may thus transition from one side to another side, for example during a tack or a jibe. The frame device may be slidable on the mast in the direction of the mast axis. In this way, the profiled sail device may be hoisted, lowered or reefed.

At least one of the fixed frame elements may have an at least two-part design. The at least two parts of this frame element may be displaceable with respect to each other. As a result of a displacement of the at least one fixed frame element, it is also possible to displace the at least two parts of this frame element with respect to each other. The at least one two-part frame element may be situated on the profile trailing edge side.

The object underlying the present invention is additionally achieved by a profiled sail device including incident-flow sail areas spaced apart from one another which form profile surfaces, a sail leading edge, and an adjustable skeleton device situated between the sail areas, in which the skeleton device includes at least one such frame device.

The longitudinal beams may each include a keder-like round rod. The longitudinal beams may each include a keder rail-like profiled rod. The profiled rods may each have a slot-shaped opening. The profiled rods may each have a C-shaped or an a-shaped profile. The round rods may be situated on the interior. The profiled rods may be situated on the exterior. The round rods may have a larger diameter than the slot-shaped openings of the profiled rods. The sail areas may include keder flap-like sections. The keder flap-like sections may each include a flap section and an accommodating section. The keder flap-like sections may be formed by topstitching. The accommodating sections may be used to accommodate the round rods. The flap sections may be used for guidance through the slot-shaped openings of the profiled rods. The first sail area may include keder flap-like sections. The second sail area may include keder flap-like sections. The sail areas may include keder flap-like sections for each frame device. The sail areas may be attached with their keder flap-like sections to the longitudinal beams.

The profiled sail device may be connected to a mast. The profiled sail device may be used with a sailing vehicle. The sailing vehicle may be a water craft or a land craft. The sailing vehicle may be a sail boat, an ice boat or a land sailer. The sail boat may be a single-hull boat or a multi-hull boat. The multi-hull boat may in particular include two or three hulls. The multi-hull boat may be a catamaran or a trimaran. The sail boat may be a hydroplane or a hydrofoil vessel. The sail boat may include a hydrofoil.

The sail boat may include one mast or multiple masts. The sail boat may be a sloop. The sail boat may be a schooner, a ketch or a yawl. The sail boat may be a sports boat. The sail boat may be a racing boat. The sail boat may be a regatta boat. The sail boat may be a cruiser. The profiled sail device may be used as a fore-and-aft sail. The profiled sail device may be used as a main sail. The profiled sail device may be used as a foresail, a gaff foresail or a spanker sail. The profiled sail device may be an oversized sail.

The at least one frame device may have a main plane which is essentially orthogonal to an axis of the mast. The skeleton device may include multiple frame devices. The frame devices may be situated essentially in parallel to each other with their main planes. The frame devices may be situated on top of each other in the extension direction of a mast.

The frame devices may be adjustable independently of each other. Multiple frame devices may be adjustable together. Multiple frame devices may be adjustable in groups. Multiple frame devices may be adjustably matched to each other. Multiple frame devices may be adjustably matched to each other in groups.

In this way, a profile is settable independently of an incident flow. A set profile may maintain its profiling even when the incident flow changes. A profile curvature is settable. A profile is invertible. A profile which is optimized for an incident flow of the first sail area is settable. A profile which is optimized for an incident flow of the second sail area is settable. A propulsion force acting on a mast may be set. A contact point of a forward propulsion force acting on a mast may be set. A momentum acting on a boat hull may be set. The profiled sail device, in particular the at least one frame device, may correspond to the principles of a lightweight construction. The profiled sail device, in particular the at least one frame device, has a high stiffness and strength. The profiled sail device is easy to handle.

The at least one frame device may be adjustable in operating positions which are between the first end position and the second end position. In this way, it is possible to set appropriate profile surfaces both for the first sail area and for the second sail area. The profile surface for the first sail area and the profile surface for the second sail area may each be different.

A first hydrofoil profile and a second hydrofoil profile may be formed with the profiled sail device. The first hydrofoil profile may be an asymmetrical hydrofoil profile, and the second hydrofoil profile may be a hydrofoil profile which is complementary to the first hydrofoil profile. The hydrofoil profile may be a normal profile whose incident-flow side (windward) is convexly curved and whose opposite side (leeward) is curved in an S shape. The hydrofoil profile may be used in a wide speed range. A dynamic propulsion may be generated with the hydrofoil profile.

"May" denotes in particular optional features of the present invention. Accordingly, there is one exemplary embodiment of the present invention in each case which includes the particular feature or the particular features.

The present invention enables a propulsion with increased efficiency. A two-way functionality is made possible. A curvature is settable independently of the wind pressure. An operability is simplified. A maximum curvature is limitable or limited. A maximum curvature is adaptably limitable or limited multiple times across a cross section of a profiled sail device. A load-carrying capacity of a limitation is increased. A limitation-induced load is absorbable in a distributed manner A limitation is absorbable across a cross section of a profiled sail device in a distributed manner. A weight is reduced. A load-carrying capacity is increased. An operability is simplified.

BRIEF DESCRIPTION OF THE DRAWINGS

Exemplary embodiments of the present invention are described in greater detail hereafter with reference to figures. Additional features and advantages are derived from this description. Specific features of these exemplary embodiments may represent general features of the present invention. Features of these exemplary embodiments combined with other features may also represent individual features of the present invention.

Schematically and by way of example.

DETAILED DESCRIPTION

Figure 1:
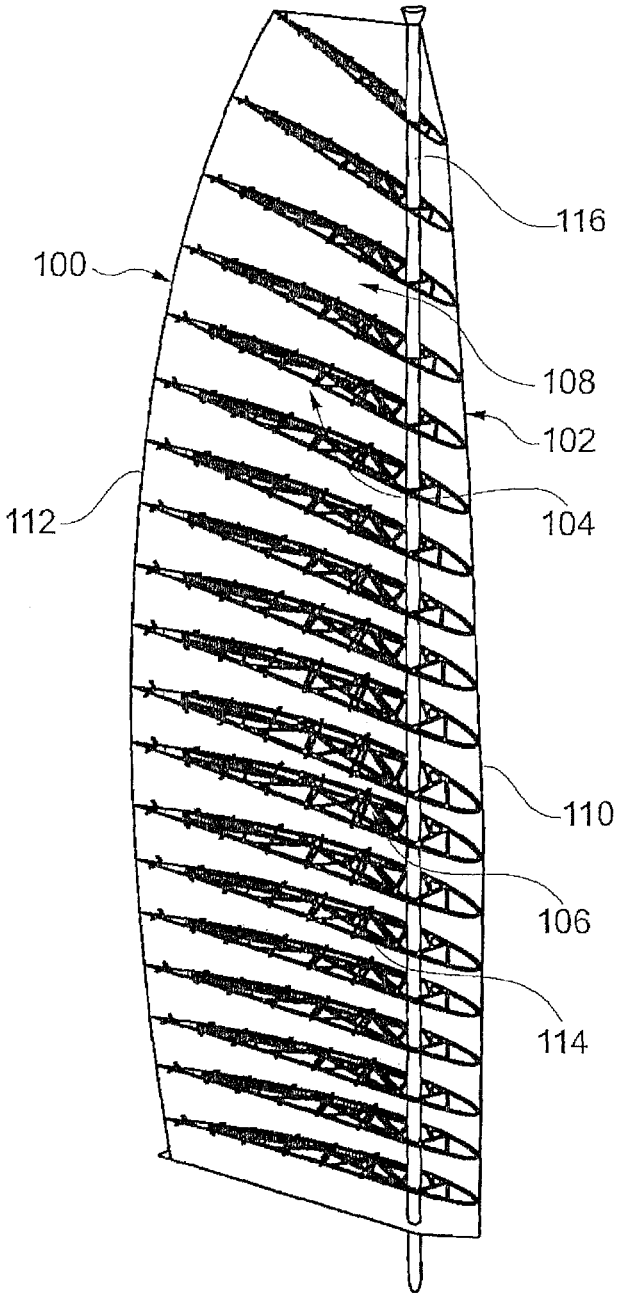
FIG. 1 shows a profiled sail device including exterior sail areas and an interior skeleton structure.

FIG. 1 shows a profiled sail device 100 including exterior sail areas 102, 104 and an interior skeleton structure 106. Profiled sail device 100 is used to propel a sailing vehicle, which is not shown in greater detail here. Skeleton structure 106 predefines the shape of profiled sail device 100. Sail areas 102, 104 are stretched over skeleton structure 106. Profiled sail device 100 has a first sail area 102 and an opposite second sail area 104. A cavity 108 in which skeleton structure 106 is situated is formed between sail areas 102, 104.

Profiled sail device 100 has a hydrofoil profile, with the aid of which a dynamic propulsion may be generated with the aid of a hydrofoil effect. The hydrofoil profile of profiled sail device 100 is adjustable between two end positions. It is possible to set operating positions for an incident flow of first sail area 102 and operating position for an incident flow of second sail area 104. The sail area to be provided with incident flow has a convexly curved surface. The opposite sail area has a surface bent in an S-shape. Profiled sail device 100 includes a leading edge 110 having an edge radius and a trailing edge 112 having a trailing edge angle. The longest line from leading edge 110 to trailing edge 112, which is identical to the chord, determines the profile depth. The profile curvature results as the largest possible deviation of a mean line from the chord. Mean line refers to the line which in the cross section of profiled sail device 100 is situated exactly between sail areas 102, 104. The profile contour of profiled sail device 100 is thus symmetrical about the mean line. Another definition reads: The mean line is the line that connects the circle center points inscribed into a profile. The profile thickness is the largest possible diameter of the circle on the mean line within the profile. The profile curvature decisively determines the maximum propulsion and is essential for a moment coefficient.

Sail areas 102, 104 may be made of a woven fabric of synthetic fibers. Sail areas 102, 104 may be formed with a laminate sail in which fibers are glued to foils or a fabric. Sail areas 102, 104 may be formed with a membrane sail in which reinforcing fibers are already introduced during the manufacture of the sail in accordance with an expected load line. Sail areas 102, 104 may include synthetic fibers, for example made of polyamide, polyester, polyethylene naphthalate, aramid and/or carbon fibers.

Skeleton structure 106 includes multiple, in the present example 19, frame devices, such as 114. Frame devices 114 each include three frame elements which are displaceable with respect to each other. In this way, profiled sail device 100 may be adjusted.

Profiled sail device 100 is situated on a mast 116. Mast 116 extends into cavity 108 and through the opening in frame devices 114 when profiled sail device 100 has been hoisted. A clearance is present between edges of the openings and the mast. Frame devices 114 are displaceable on mast 116 to a limited extent. Frame devices 114 are slidable on mast 116 in the direction of the mast axis. Frame devices 114 are pivotable about mast 116. In this way, profiled sail device 100 is pivotable about mast 116. Mast 116 extends in the hydrofoil profile behind leading edge 110 so that a smaller section of profiled sail device 100 extends between mast 116 and leading edge 110, and a larger section of profiled sail device 100 extends between mast 116 and profile trailing edge 112. In the present example, mast 116 is fixedly, in particular non-rotatably, connected to a vehicle body, such as a boat hull. Mast 116 may be situated on a keel and be guided through a deck. Alternatively, mast 116 may be situated on the deck and be supported from beneath on the keel.

Figure 2:
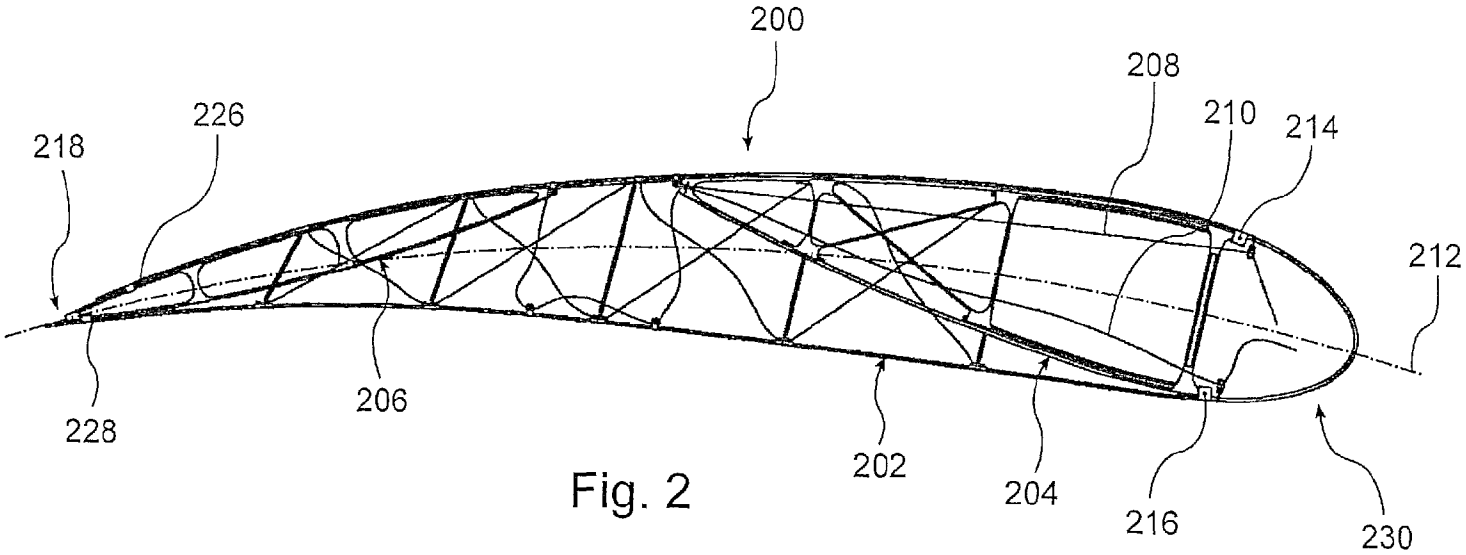
FIG. 2 shows a frame device for a profiled sail device including an adjustable frame element, two fixed frame elements situated displaceably on the adjustable frame element, and actuating ropes.
Figure 3:
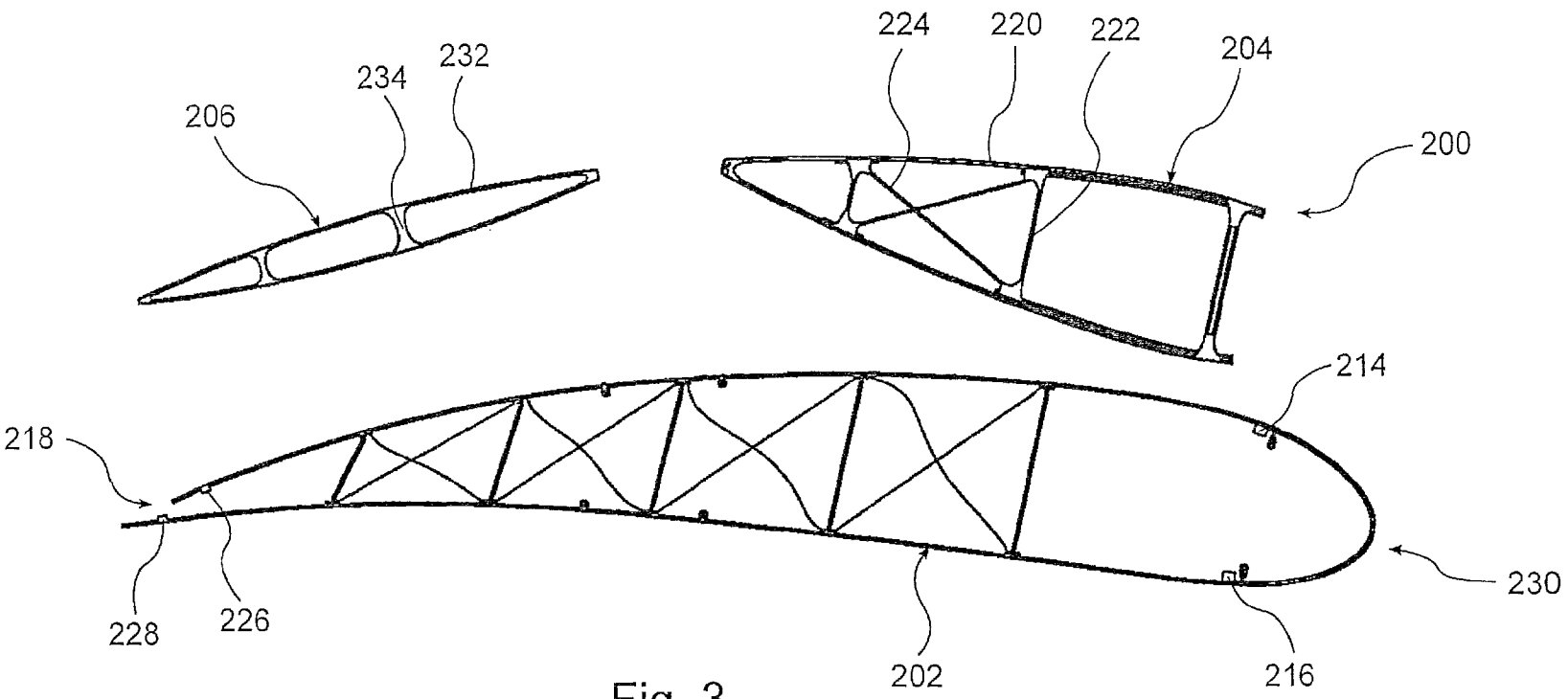
FIG. 3 shows a frame device for a profiled sail device including an adjustable frame element and two fixed frame elements in a non-assembled state.

FIG. 2 shows a frame device 200 for a profiled sail device including an adjustable frame element 202, two fixed frame elements 204, 206 situated displaceably on adjustable frame element 202, and actuating ropes 208, 210. FIG. 3 shows frame device 200 in the unassembled state.

Proceeding from a neutral center position, frame device 200 and adjustable frame element 202 are optionally adjustable into a first end position or into a second end position. FIG. 2 shows frame device 200 in the first end position. Adjustable frame element 202 forms a central frame element. Frame device 200 and adjustable frame element 202 have a longitudinal axis 212. In the neutral center position, longitudinal axis 212 is straight. During an adjustment in the direction of the end positions, longitudinal axis 212 is bent.

Adjustable frame element 202 includes two pivot bearings 214, 216 on the leading edge side, to which fixed frame element 204 together with adjustable frame element 202 is displaceably connected. Proceeding from pivot bearings 214, 216, fixed frame element 204 essentially extends in the direction of trailing edge 218. Fixed frame element 204 is displaceable between a first end position and a second end position.

Fixed frame element 204 includes longitudinal beams such as 220, transverse beams such as 222, and diagonal members such as 224. Fixed frame element 204 has an elongated triangular-like shape having a shorter base and legs curved in a tapered manner. At the corners assigned to the base, fixed frame element 204 is pivotably connected to pivot bearings 214, 216. Fixed frame element 204 has a comparatively rigid design in itself.

Adjustable frame element 202 includes two sliding sleeves 226, 228 on the trailing edge side, to which fixed frame element 206 together with adjustable frame element 202 is displaceably connected. Proceeding from sliding sleeves 226, 228, fixed frame element 206 essentially extends in the direction of leading edge 230. Fixed frame element 206 is displaceable between a first end position and a second end position.

Fixed frame element 206 includes longitudinal beams, such as 232, and transverse beams, such as 234. Fixed frame element 206 has a needle-like shape having longitudinal beams 232 curved in a tapered manner on either side. At one end, fixed frame element 206 is slidably connected to adjustable frame element 202 with the aid of sliding sleeves 226, 228. Fixed frame element 206 has a comparatively rigid design in itself.

Actuating ropes 208, 210 are guided on adjustable frame element 202 and on fixed frame element 204 and connected to fixed frame element 206 with tensile strength in such a way that a tensile force of actuating rope 208 causes an adjustment in the direction of the first end position, and a tensile force of actuating rope 210 causes an adjustment in the direction of the second end position. This results in a counter-displacement of fixed frame elements 204, 206, so that fixed frame elements 204, 206 in the first end position form a profile contour for a first sail area, while a profile contour for a second sail area is formed by adjustable frame element 202, and in the second end position from a profile contour for the second sail area, while a profile contour for the first sail area is formed by adjustable frame element 202. Incidentally, reference is additionally made in particular to FIG. 1 and the related description.

Figure 4:
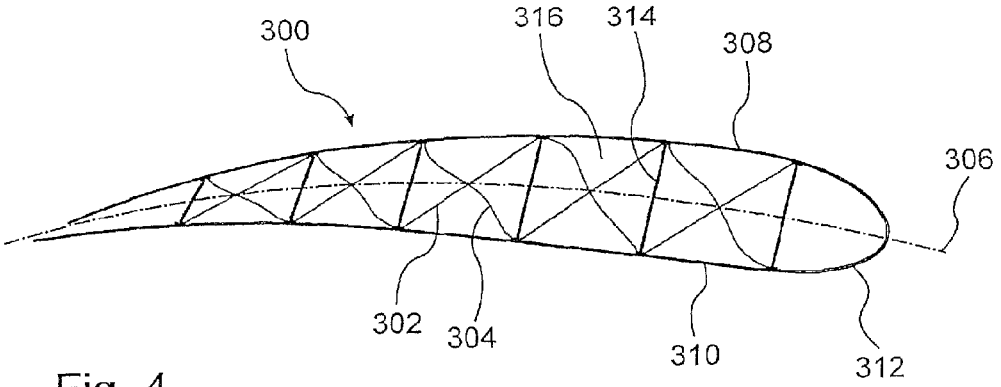
FIG. 4 shows an adjustable frame element of a frame device including fixed tension elements to limit maximum lengths of diagonals.

FIG. 4 shows an adjustable frame element 300 of a frame device including fixed tension elements, such as 302, 304, to limit maximum lengths of the diagonals.

Frame element 300 has a longitudinal axis 306. In the neutral center position, longitudinal axis 306 is straight. During an adjustment in the direction of the end positions, frame element 300 is bent elastically along longitudinal axis 306. FIG. 4 shows frame element 300 in the bent position.

Frame element 300 has a drop-shaped outer contour. Frame element 300 includes longitudinal beams 308, 310. Longitudinal beams 308, 310 each have a front end and a rear end. Longitudinal beams 308, 310 are connected to each other at their front ends with the aid of a bowed section 312. Proceeding from their front ends, longitudinal beams 308, 310 are situated to converge in the direction of their rear ends. Longitudinal beams 308, 310 and bowed section 312 are used to delimit a cross section of a profiled sail device, such as profiled sail device 100 according to FIG. 1. Bowed section 312 forms a leading edge of the profiled sail device, and the rear ends of longitudinal beams 308, 310 are assigned to a trailing edge.

The rear ends of longitudinal beams 308, 310 are free and displaceable with respect to each other during an adjustment of frame element 300 in the extension direction of longitudinal axis 306. Longitudinal beams 308, 310 are elastically bendable. Frame element 300 includes transverse beams, such as 314. Transverse beams 314 extend between longitudinal beams 308, 310 and hold longitudinal beams 308, 310 in a spaced apart position. Transverse beams 314 are used as compression members and are essentially rigid. Longitudinal beams 308, 310 and transverse beams 314 delimit convex quadrangles, such as 316, each having four corners and two intersecting diagonals. Tension elements 302, 304 each have two ends. Tension elements 302 are attached at their ends in opposing corners of quadrangles 316. Tension elements 304 are attached at their ends in opposing corners of quadrangles 316. Tension elements 302, 304 are situated so as to intersect.

During an adjustment of frame element 300, quadrangles 316 deform in a parallelogram-like manner. As a result, the lengths of the diagonals change. When frame element 300 has been adjusted into an end position, one diagonal of quadrangles 316 has a maximum length and the other diagonal has a minimum length. The maximum lengths of the diagonals are limited by the lengths of tension elements 302, 304. When frame element 300 has been adjusted into an end position, tension elements 302 or tension elements 304 are tensioned, independently of the end position, so that a further adjustment of frame element 300 is prevented. In the present example, limp ropes serve as tension elements 302, 304. Tension elements 302, 304 assigned to the shorter diagonals may thus sag without tensile stress. Incidentally, reference is additionally made in particular to FIG. 2 and FIG. 3 and the related description.

Figure 5:
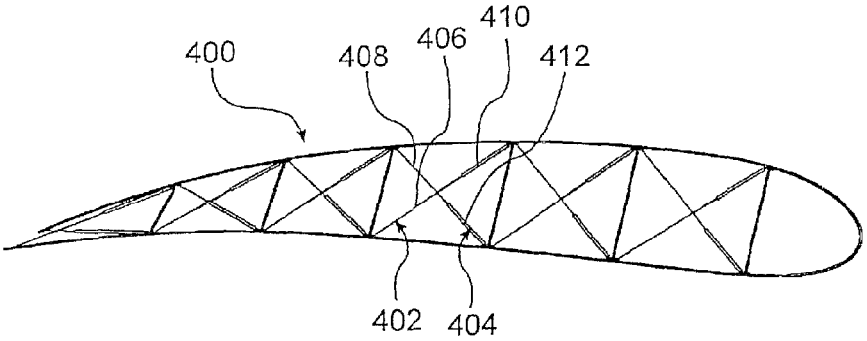
FIG. 5 shows an adjustable frame element of a frame device including adjustable tension elements to limit maximum lengths of diagonals.

FIG. 5 shows an adjustable frame element 400 of a frame device including adjustable tension elements 402, 404 to limit maximum lengths of diagonals.

Tension elements 402, 404 each include a rope section 406, 408 having a fixed length and a length-adjustable tension section 410, 412. Tension sections 410, 412 may each be mechanically, electromechanically, pneumatically and/or hydraulically length-adjustable. The maximum lengths of the diagonals are thus settable. The end positions of frame device 200 are thus settable. A shape of frame device 200 in the end positions is thus settable. Incidentally, reference is additionally made in particular to FIG. 4 and the related description.

Figure 6:
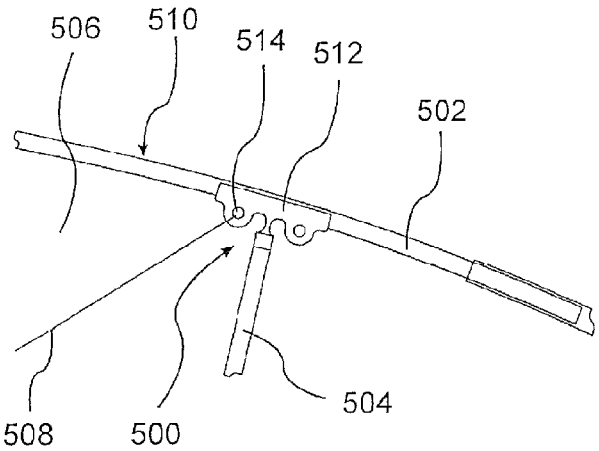
FIG. 6 shows a detailed view of a corner of a quadrangle, which is delimited by longitudinal beams and transverse beams, including a tension element.

FIG. 6 shows a detailed view of a corner 500 of a quadrangle 506 delimited by longitudinal beams, such as 502, and transverse beams, such as 504, including a tension element 508. Adjustable frame element 510 includes connecting elements, such as 512. Connecting elements 512 are used to connect longitudinal beams 502 and transverse beams 504 and to attach tension elements 508. Connecting elements 512 each include fixed sections for accommodating longitudinal beams 502 and transverse beams 504. Connecting elements 512 each include a flexible section situated between the fixed sections. Connecting elements 512 each include eye-shaped attachment points, such as 514, for attaching tension elements 508. Connecting element 512 is situated at a nodal point between longitudinal beam 502 and transverse beam 504 and is used to attach two tension elements, such as 508, of two adjoining quadrangles, such as 506. Incidentally, reference is additionally made in particular to FIGS. 2 through 5 and the related description.

Figure 7:
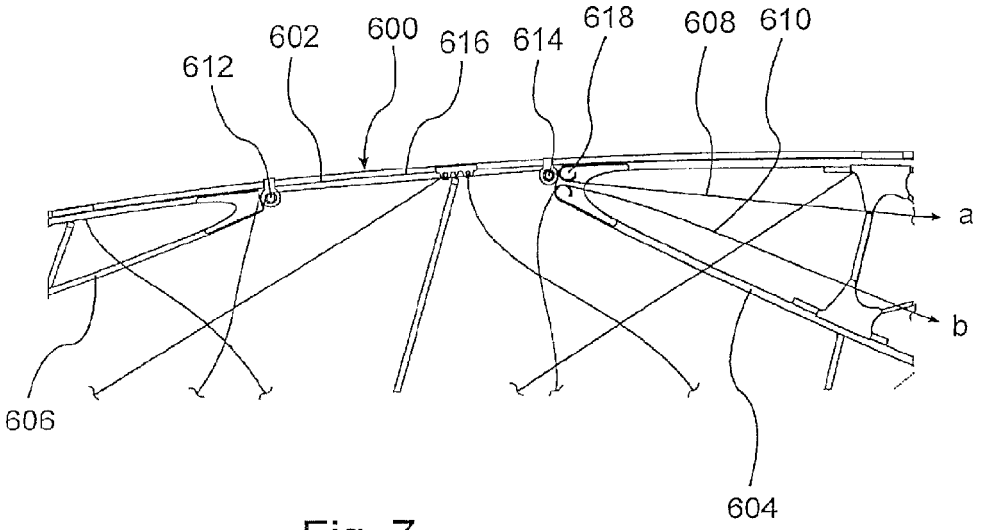
FIG. 7 shows a detailed view of a frame device for a profiled sail device including an adjustable frame element, two fixed frame elements situated displaceably on the adjustable frame element, and actuating ropes.

FIG. 7 shows a detailed view of a frame device 600 for a profiled sail device including an adjustable frame element 602, two fixed frame elements 604, 606 situated displaceably on adjustable frame element 602, and actuating ropes 608, 610.

In the end position shown, actuating rope 608 is pulled actively in the direction of arrow a, and actuating rope 610 is inactive. Actuating rope 608 is guided with the aid of two rollers 612, 614 on longitudinal beam 616 of frame element 602. Frame element 604 includes a guide 618 on which actuating rope 608 is guided. Actuating rope 608 is connected at one end to frame element 606 with tensile strength. A pull of actuating rope 608 in the direction of arrow a causes frame elements 604, 606 to be counter-displaced in such a way that frame elements 604, 606 are displaced toward longitudinal beam 616 of frame element 602. Actuating rope 610 is also guided on the longitudinal beam of frame element 602, which is not apparent here. A pull of actuating rope 610 in the direction of arrow b, with an inactive actuating rope 608, causes frame elements 604, 606 to be counter-displaced in the opposite direction in such a way that frame elements 604, 606 are displaced toward the longitudinal beam of frame element 602, which is not apparent here. Incidentally, reference is additionally made in particular to FIGS. 2 through 5 and the related description.

Figure 8:
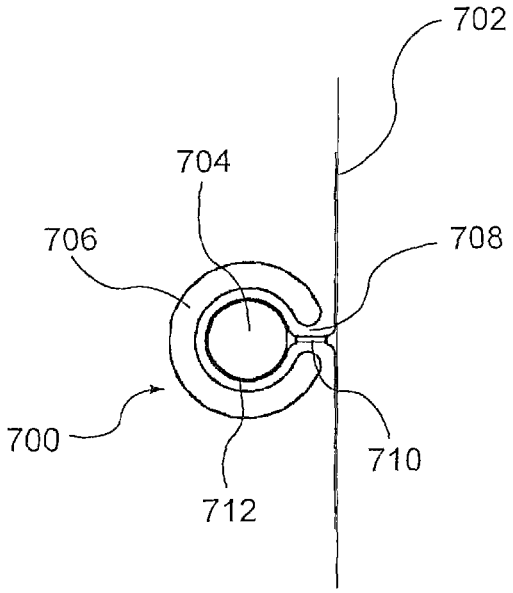
FIG. 8 shows a longitudinal beam of an adjustable frame element having a C-profile and a sail area attached thereto in a sectional view.

FIG. 8 shows a longitudinal beam 700 of an adjustable frame element having a C-profile and sail area 702 attached thereto in a sectional view. The longitudinal beams such as 700, each have a keder-like round rod 704 and a keder rail-like profiled rod 706 having a slot-shaped opening 708. Round rod 704 is situated in the interior, and profiled rod 706 is situated in the exterior. Round rod 704 has a larger diameter than slot-shaped opening 708. Sail area 702 includes keder flaps formed by topstitching including a flap section 710 for guidance through opening 708 and an accommodating section 712 for round rod 704. Sail area 702 is attached to longitudinal beam 700 with the aid of the keder flap. Profiled rod 706 has a C-shaped profile in the present example. Incidentally, reference is additionally made in particular to FIGS. 1 through 3 and the related description.

Figure 9:
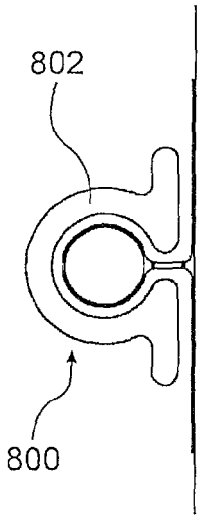
FIG. 9 shows a longitudinal beam of an adjustable frame element having a Ω-profile and a sail area attached thereto in a sectional view.

FIG. 9 shows a longitudinal beam 800 of an adjustable frame element having an Ω-profile and a sail area attached thereto in a sectional view. Profiled rod 802 has an Ω-shaped profile in the present example. Incidentally, reference is additionally made in particular to FIG. 8 and the related description.

Figure 10:
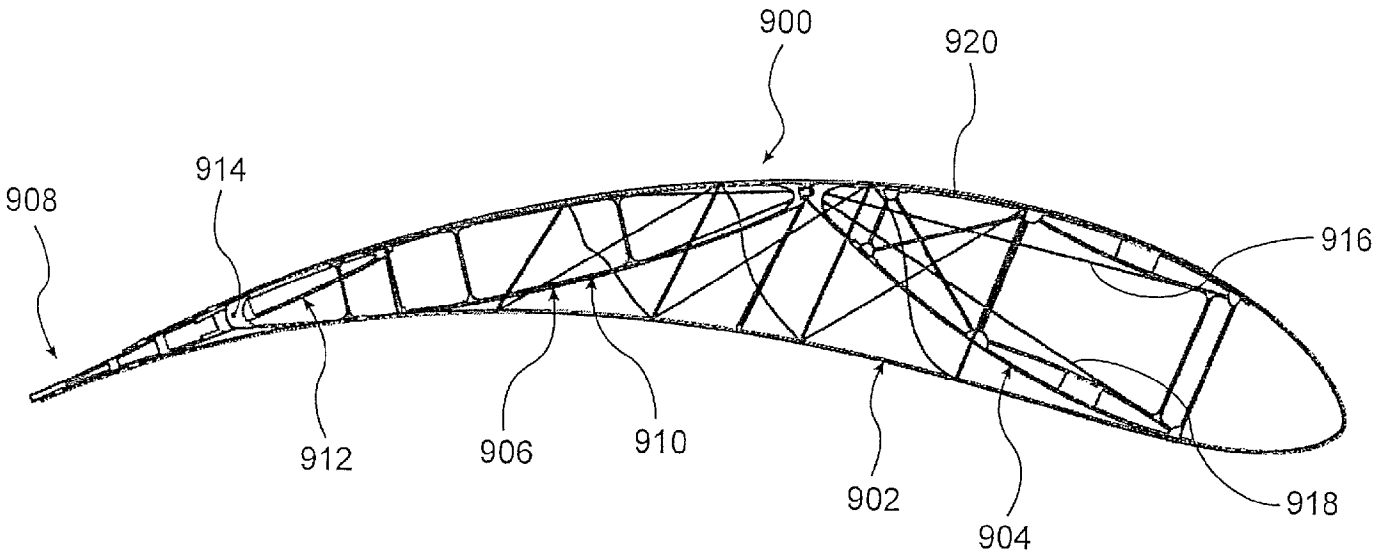
FIG. 10 shows a frame device for a profiled sail device including an adjustable frame element and two fixed frame elements situated displaceably on the adjustable frame element, one of the fixed frame elements having a two-part design.

FIG. 10 shows a frame device 900 for a profiled sail device including an adjustable frame element 902 and two fixed frame elements 904, 906 situated displaceably on adjustable frame element 902, fixed frame elements 906 having a two-part design. Fixed frame element 906 is assigned to trailing edge 908. Fixed frame element 906 includes a first part 910 and a second part 912. First part 910 is situated on the leading edge side. Second part 912 is situated on the trailing edge side. First part 910 and second part 912 are mounted on each other with the aid of a pivot bearing 914. Second part 912, together with one end, forms trailing edge 908.

Two actuating ropes 916, 918 are provided for actuation. Actuating ropes 916, 918 are guided on adjustable frame element 902, fixed frame element 904, first part 910 of fixed frame element 906 and second part 912 of fixed frame element 906, or are connected thereto, in such a way, that a tensile force of actuating rope 916 causes an adjustment in the direction of an end position, and a tensile force of actuating rope 918 causes an adjustment in the direction of another end position. This results in a counter-displacement of fixed frame elements 904, 906 and a co-displacement of first part 910 and second part 912. An adjustment in the direction of the one end position takes place differently from an adjustment in the direction of the other end position. In one adjustment direction, fixed frame elements 904, 906 with their ends facing each other are pulled with the aid of an actuating rope toward longitudinal beam 920, proceeding from a deflection on a longitudinal beam 920. In the other adjustment direction, an actuating rope guides an angle between fixed frame elements 904, 906 over a lever system. Longitudinal beam 920 follows the adjustment guided by sliding guides.

With the aid of second part 912 of fixed frame element 906, an improved defined setting of trailing edge 908 is made possible. Incidentally, reference is additionally made in particular to FIG. 2 and FIG. 3 and the related description.

LIST OF REFERENCE NUMERALS

100 profiled sail device
102 sail area
104 sail area
106 skeleton structure
108 cavity
110 leading edge
112 trailing edge
114 frame device
116 mast
200 frame device
202 adjustable frame element
204 fixed frame element
206 fixed frame element
208 actuating rope
210 actuating rope
212 longitudinal axis
214 pivot bearing
216 pivot bearing
218 trailing edge
220 longitudinal beam
222 transverse beam
224 diagonal member
226 sliding sleeve
228 sliding sleeve

230 leading edge
232 longitudinal beam
234 transverse beam
300 adjustable frame element
302 fixed tension element
304 fixed tension element
306 longitudinal axis
308 longitudinal beam
310 longitudinal beam
312 bowed section
314 transverse beam
316 quadrangle
400 adjustable frame element
402 adjustable tension element
404 adjustable tension element
406 rope section
408 rope section
410 length-adjustable tension section
412 length-adjustable tension section
500 corner
502 longitudinal beam
504 transverse beam
506 quadrangle
508 tension element
510 adjustable frame element
512 connecting element
514 attachment point
600 frame device
602 adjustable frame element
604 fixed frame element
606 fixed frame element
608 actuating rope
610 actuating rope
612 roller
614 roller
616 longitudinal beam
618 guide
700 longitudinal beam
702 sail area
704 round rod
706 profiled rod
708 opening
710 flap section
712 accommodating section
800 longitudinal beam
802 profiled rod
900 frame device
902 adjustable frame element
904 fixed frame element
906 fixed frame element
908 trailing edge
910 first part
912 second part
914 pivot bearing
916 actuating rope
918 actuating rope
920 longitudinal beam

What is claimed is:

1. A frame device for a profiled sail device, the frame device comprising:

at least one adjustable frame element including longitudinal beams spaced apart from one another and assigned to sail areas spaced apart from one another, and transverse beams extending between the longitudinal beams, the longitudinal beams and the transverse beams delimiting quadrangles, each quadrangle having two diagonals having lengths varying as a function of adjustment of the adjustable frame element, the diagonals each having a predetermined maximum length.

2. The frame device as recited in claim 1 further comprising tension elements for predetermining the maximum lengths of the diagonals.

3. The frame device as recited in claim 2 wherein the tension elements each have a fixed length.

4. The frame device as recited in claim 2 wherein the tension elements each have a settable length.

5. The frame device as recited in claim 2 wherein the tension elements are formed with the aid of ropes having a fixed or settable length.

6. The frame device as recited in claim 5 wherein the tension elements each include one rope section having a fixed length and one length-adjustable tension section.

7. The frame device as recited in claim 6 wherein the tension sections are each mechanically, electromechanically, pneumatically or hydraulically length-adjustable.

8. The frame device as recited in claim 1 further comprising at least one further frame element situated displaceably on the at least one adjustable frame element, the further frame element have a fixed nonadjustable shape so as to define at least one fixed frame element.

9. The frame device as recited in claim 8 wherein a displacement of the at least one fixed frame element causes an adjustment of the at least one adjustable frame element.

10. The frame device as recited in claim 8 wherein the at least one fixed frame element is displaceable with the aid of actuatable tension elements.

11. The frame device as recited in claim 8 wherein the at least one fixed frame element includes at least two fixed frame elements situated displaceably on the at least one adjustable frame element, the at least two fixed frame elements being counter-displaceable with the aid of actuatable tension elements.

12. The frame device as recited in claim 11 wherein the at least two fixed frame elements are displaceable together in a first displacement direction with the aid of a first tension element of the actuable tension elements, and are displaceable together in a second displacement direction opposite the first displacement direction with the aid of a second tension element of the actuable tension elements.

13. The frame device as recited in claim 11 wherein at least one of the fixed frame elements has an at least two-part design, and the at least two parts of the at least one fixed frame element are displaceable with respect to each other.

14. The frame device as recited in claim 13 wherein as a result of a displacement of the at least one fixed frame element, the at least two parts of the frame element are displaceable with respect to each other.

15. A profiled sail device comprising:

incident-flow sail areas spaced apart from one another and forming profile surfaces, a sail leading edge; and an adjustable skeleton device situated between the sail areas, the skeleton device including the frame device as recited in claim 1.

16. The profiled sail device as recited in claim 15 wherein the longitudinal beams each include a keder round rod in the interior and a keder rail profiled rod in the exterior, the sail areas including keder flap sections, the sail areas attached with the keder flap sections to the longitudinal beams.

17. The profiled sail device as recited in claim 16 wherein the keder rail profiled rods of the longitudinal beams each have a C-shaped or an Ω-shaped profile.

18. The frame device as recited in claim 1 wherein the transverse beams contact longitudinal beams at a same location with respect to the longitudinal beams, irrespective of the varying of the lengths of the two diagonals.

19. The frame device as recited in claim 1 wherein the longitudinal beams have rear ends that are free and displaceable with respect to each other.

* * * * *